United States Patent [19]

Jones

[11] 4,213,370

[45] Jul. 22, 1980

[54] MOLDED PLASTIC GUITARS

[75] Inventor: Charles E. Jones, Evanston, Ill.

[73] Assignee: WMI Corporation, Chicago, Ill.

[21] Appl. No.: 918,059

[22] Filed: Jun. 22, 1978

[51] Int. Cl.[2] ..... G10D 3/00; G10D 3/04; G10D 3/14

[52] U.S. Cl. ..... 84/291; 84/293; 84/298; 84/306

[58] Field of Search ..... 84/267, 291, 298, 299, 84/307

[56] References Cited

U.S. PATENT DOCUMENTS

| | | | |
|---|---|---|---|
| 1,170,999 | 2/1916 | Schultz | 84/298 |
| 1,881,229 | 10/1932 | Young | 84/291 |
| 1,889,408 | 11/1932 | Larson | 84/291 X |
| 2,588,101 | 3/1952 | Finder | 84/291 |
| 2,597,154 | 5/1952 | Maccaferri | 84/267 |
| 2,793,556 | 5/1957 | Maccaferri | 84/267 |
| 3,443,466 | 5/1969 | Brakewell | 84/291 |
| 3,474,697 | 10/1969 | Kaman | 84/267 |
| 3,515,024 | 6/1970 | Broussard | 84/291 |
| 3,563,126 | 2/1971 | Connington | 84/298 |
| 3,656,395 | 4/1972 | Kaman | 84/267 |
| 3,722,345 | 3/1973 | Dopera | 84/291 |
| 3,892,159 | 7/1975 | Houtsma | 84/291 X |
| 3,911,778 | 10/1975 | Martin | 84/267 |
| 3,974,730 | 8/1976 | Adams, Jr. | 84/291 |
| 4,016,793 | 4/1977 | Kasha | 84/267 |

FOREIGN PATENT DOCUMENTS

| | | | |
|---|---|---|---|
| 1473187 | 3/1967 | France | 84/291 |

*Primary Examiner*—L. T. Hix

*Assistant Examiner*—Thomas H. Tarcza

*Attorney, Agent, or Firm*—Hill, Van Santen, Steadman, Chiara & Simpson

[57] ABSTRACT

The soundbox body is a one piece plastic molding having an offset bottom concave-convex substantially parabolic sound reflector area joined by a reinforcing rib structure to the wall of the body. A top panel is mounted on a supporting and reinforcing frame attached to the upper edges of the body wall. A neck molded from lightweight plastic has lightweight metal reinforcement extending longitudinally therein. An attachment heel structure on the neck is received and secured in a complementary socket in the upper bout of the soundbox body. Tuning gear is housed in complementary bearing recesses formed complementally in a head panel on the neck and a head plate removably secured to the head panel, and providing bearing holes through which tuning posts extend for attachment of the tuning ends of the playing strings which extend therefrom over an adjustable nut and spaced over the finger board, and then across a sound hole bordered by a ring member locating a pick guard. Anchorage for the strings is provided by a bridge structure comprising a base member on which is mounted a pad carrying a saddle, the pad having means securing the bridge assembly in place on the top panel. Attached to the lower face of the top panel is a bracing structure comprising bars and ribs in a one piece molding together with the supporting and reinforcing frame and including an attachment pad underlying the bridge structure to which the bridge pad is attached.

44 Claims, 15 Drawing Figures

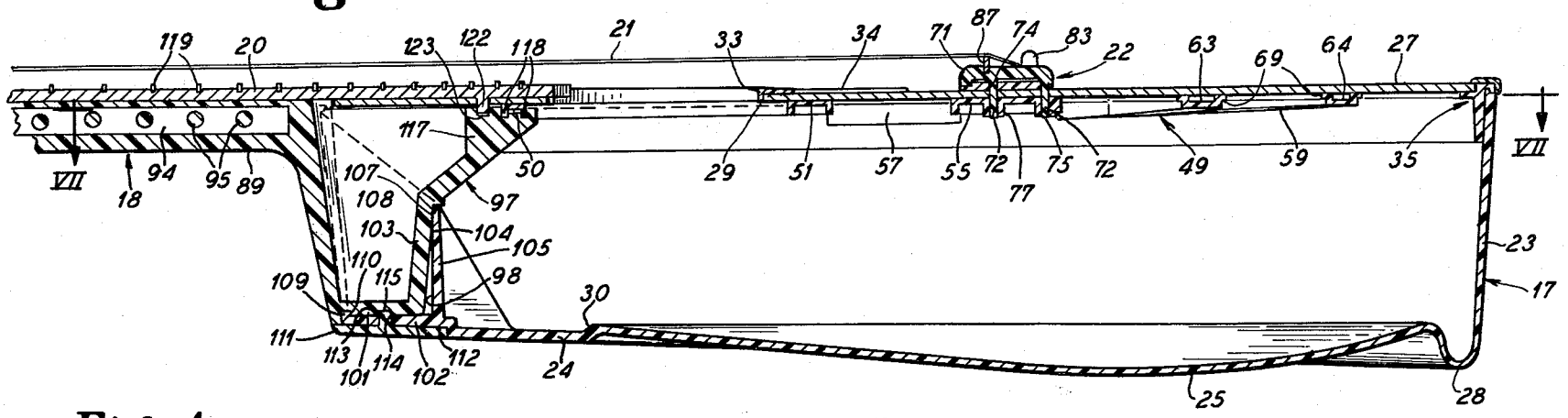
Fig. 3
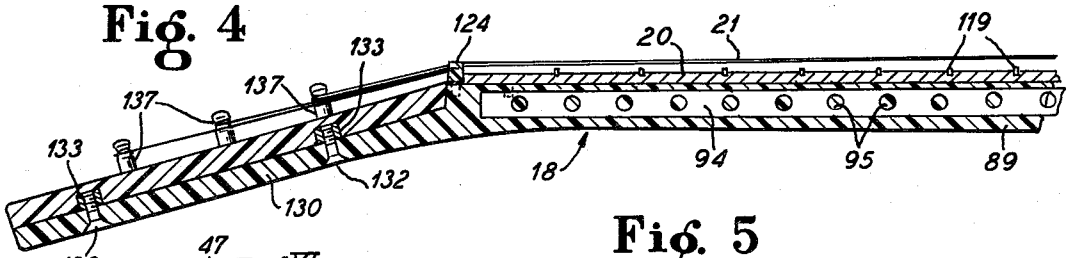
Fig. 4
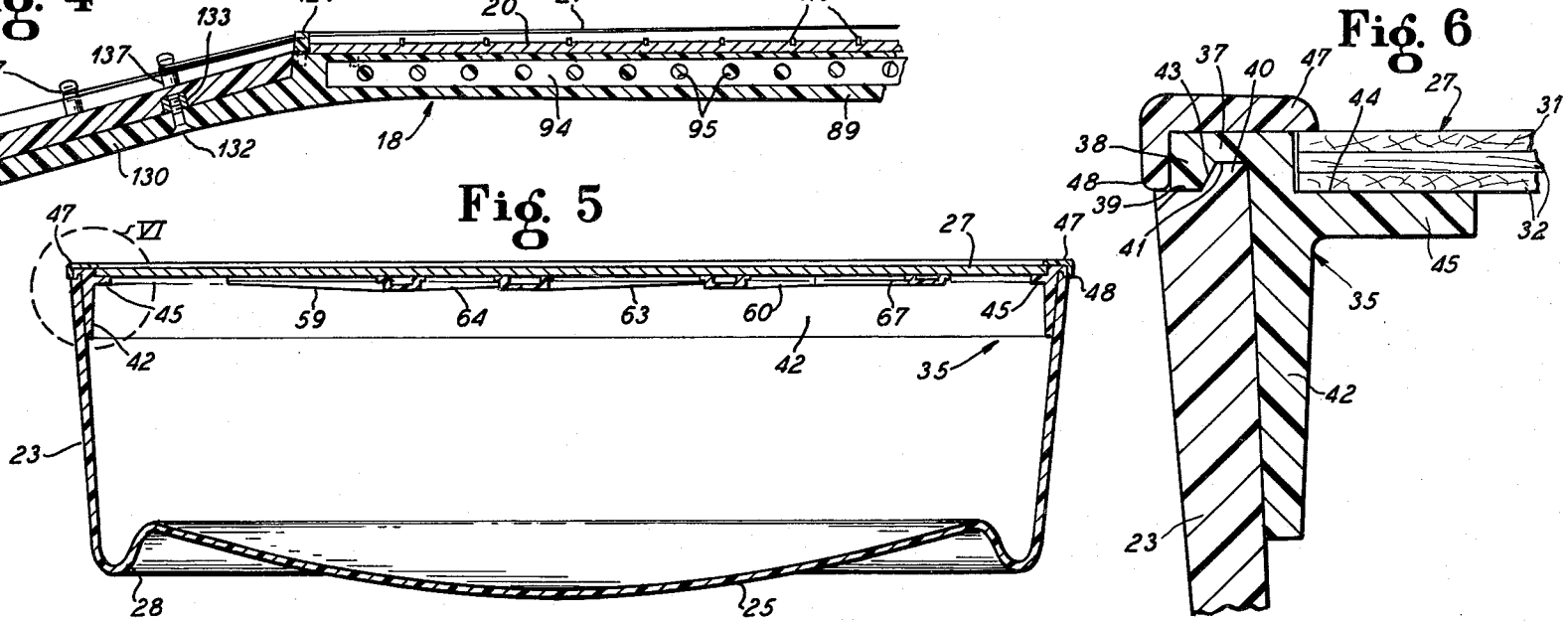
Fig. 5
Fig. 6

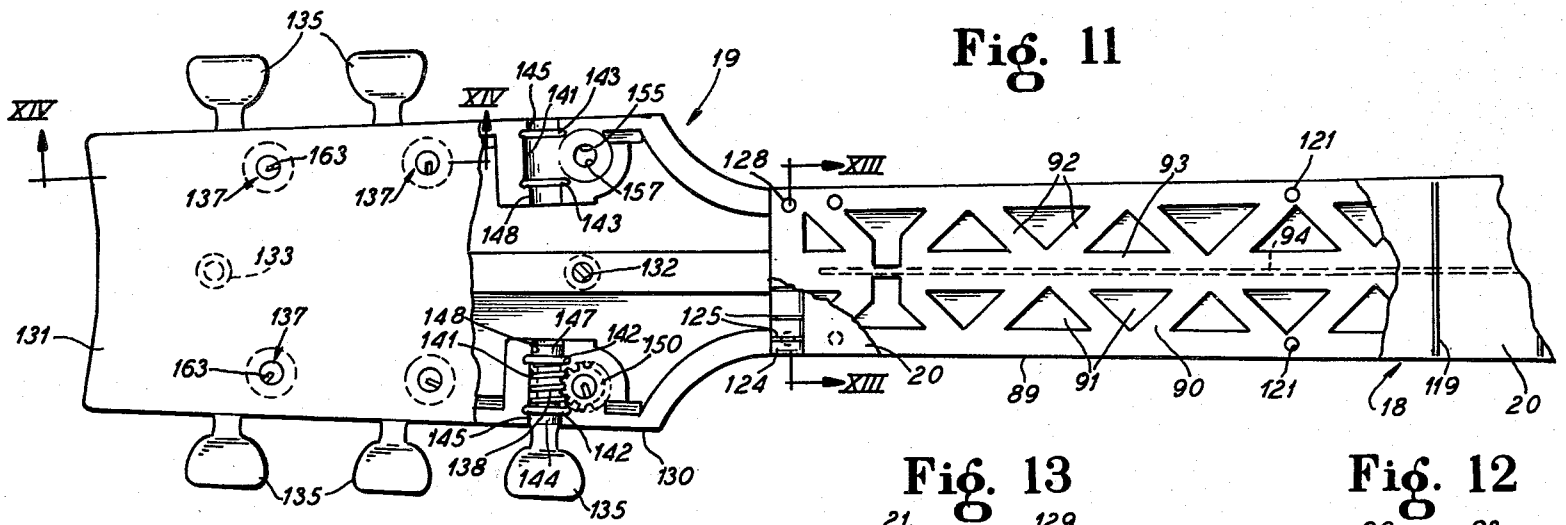
Fig. 11
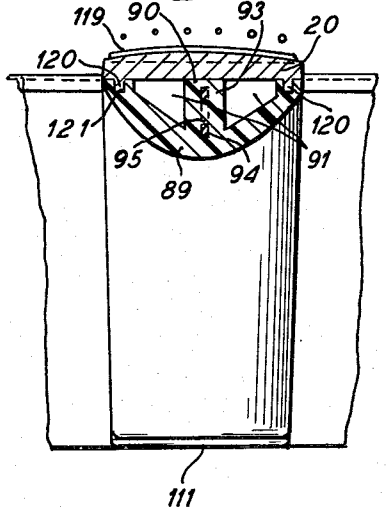
Fig. 12
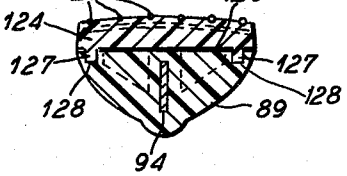
Fig. 13
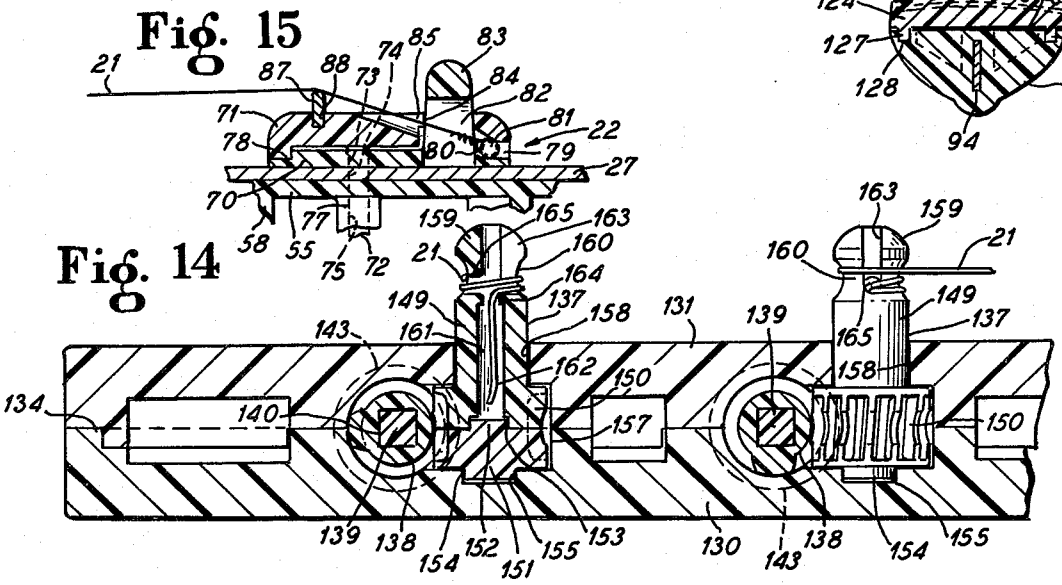
Fig. 14
Fig. 15

MOLDED PLASTIC GUITARS

The present invention relates to molded plastic guitars, and is more particularly concerned with various improved structures and relationships in such guitars.

Although guitars have heretofore been made with molded plastic soundbox bodies, molded plastic necks, and other plastic parts, there is still room for substantial improvement in such guitars, especially to adapt their construction to modern production technology, materials, and subassembly procedures, parts reduction, improved tonal qualities, weight reduction without sacrificing strength, and the attainment of maximum economy both as to materials and production costs.

An important object of the present invention is to provide a new and improved molded plastic guitar, which will overcome the disadvantages, drawbacks, inefficiencies, shortcomings and problems inherent in the prior art.

In a preferred embodiment of the invention, a molded plastic guitar is provided having a soundbox body comprising a one piece plastic molding having an upwardly offset bottom concave-convex substantially parabolic sound reflector area joined by a reinforcing rib structure to the wall of the body. A top soundboard panel is mounted on a molded plastic supporting and bracing frame structure which is attached to the upper edges of the body wall, and to the underside of the panel. A neck molded from lightweight plastic has lightweight metal reinforcement extending longitudinally therein. An attachment heel structure on the neck is received and secured in a complementary socket in the upper bout of the soundbox body. Tuning gear is housed in complementary housing and bearing recesses formed complementally in a head panel on the neck and a head plate removably secured to the head panel, which provides bearing holes through which tuning posts extend for attachment of the tuning ends of the playing strings which extend therefrom over an adjustable nut and spaced over the finger board, and then across a sound hole bordered by a ring member locating a pick guard. Anchorage for the strings is provided by a bridge structure comprising a base member on which is mounted a pad carrying a saddle, the pad having means securing the bridge assembly in place on the top panel.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which:

FIG. 3 is a sectional detail view taken substantially along the line III—III of FIG. 1.

FIG. 4 is an enlarged fragmentary sectional detail view taken along the line IV—IV of FIG. 1.

FIG. 5 is a sectional detail view taken substantially along the line V—V of FIG. 1.

FIG. 6 is an enlarged fragmentary sectional detail view of that portion of FIG. 5 within the balloon VI.

FIG. 11 is a fragmentary top plan view of the head end portion of the neck partially broken away to reveal details of structure.

FIG. 12 is a fragmentary vertical sectional detail view taken substantially along the line XII—XII of FIG. 10.

FIG. 13 is a fragmentary sectional detail view taken substantially along the line XIII—XIII of FIG. 11.

FIG. 14 is an enlarged fragmentary sectional detail view taken substantially along the line XIV—XIV of FIG. 11; and FIG. 15 is an enlarged fragmentary sectional detail view taken substantially along the line XV—XV of FIG. 1.

Figure 1:
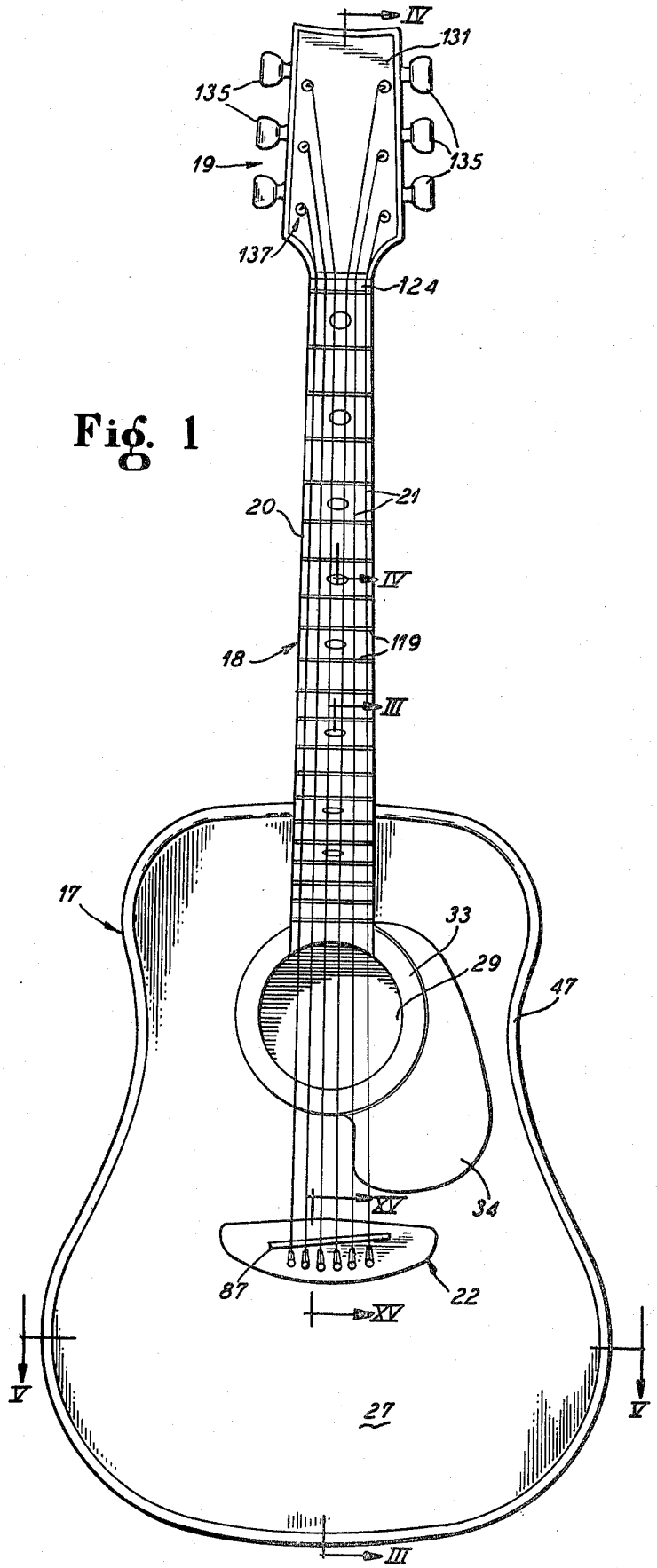
FIG. 1 is a top plan view of a guitar embodying the invention.
Figure 2:
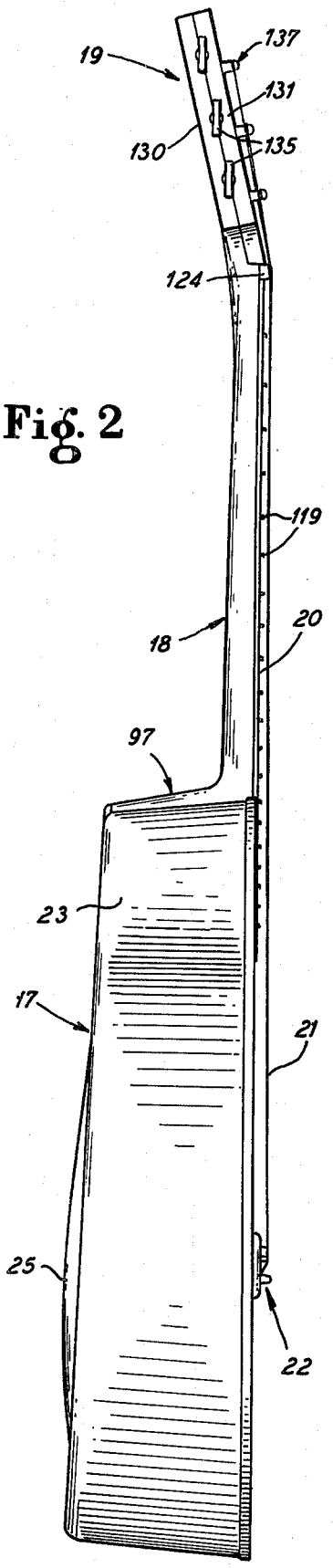
FIG. 2 is a side elevational view of the guitar.

In a preferred embodiment of the invention (FIGS. 1 and 2) the guitar comprises a soundbox 17 in the form of a hollow body of substantially usual shape in plan, provided with upper and lower bouts and intermediate bouts defining the waist of the instrument. Attached to the upper bout of the body 17 is a neck 18 having a machine or tuning gear head 19 and carrying a fretted finger board 20 over which extend the desired number of longitudinal strings 21 with their fixed ends anchored to a bridge assembly 22.

In a desirable construction, the body 17 is fabricated as a unitary one piece molding formed from suitable plastic such as injection molded styrene acrylonitrile copolymer with glass fiber reinforcement. Such material has rigidity and exceptionally hard surfaces. In the molded configuration of the body 17, it has a wall 23 which defines the upper and lower as well as the side bouts and extends substantially straight between the top and bottom of the body as best seen in FIGS. 3 and 5. For maximum rigidity and other purposes, the wall 23 is as wide as may practicably be provided for such an instrument, and is of a tapered thickness section with maximum thickness at the top and tapering down to minimum thickness at its lower end where it joins an integral bottom 24 having the major extent of its area shaped to provide a concave-convex substantially parabolic resonant sound reflector 25 underlying the principal resonant area of a top panel or sounding board 27 carried by the top edge of the wall 23. A unique feature of the downwardly convex, upwardly concave reflector 25 is that it is offset or setback relative to the lower edge of the wall 23. This is advantageous for minimizing the over all height of the instrument, while nevertheless, maximizing the width of the wall 23. Another advantage of this construction resides in the provision of a bracing rib 28 connecting the bottom of the wall 23 with the reflector 25. By virtue of its ogee or substantially S-shape transverse cross section, the rib 28 joins the wall 23 and the reflector area 25 on respective transversely angular open junctures and is easy to form by injection molding, providing substantial stiffening reinforcement for the wall 23 framing the reflector 25 while affording excellent vibrational resonance for brilliant tone qualities in playing of the instrument. As will be observed in FIG. 3, the bottom reflector 25 is of an area substantially aligned with the resonance area of the soundboard 27, with the end of the reflector 25 nearest the upper bout of the body 17 generally adjacent the upper side of a sound opening 29 in the upper portion of the soundboard 27. Juncture of the reflector with the remaining portion of the bottom 24 is along a minimal rib 30 as substantially a continuation of the top of the juncture rib 28, whereby to maintain the resonance effectiveness of the reflector 25.

Although the soundboard 27 may comprise a plastic panel made from suitable material, in a preferred construction, it comprises either a solid panel of spruce wood or, as shown in FIG. 6, a plywood panel in which a top spruce ply 31 is bonded to one or more bottom plies 32 of a less costly wood such a poplar, the grain of the spruce ply 31 running longitudinally with the axis of the instrument. About the sound opening 29 is mounted a rosette or purfling ring 33 (FIGS. 1 and 3), which is of general L-shaped cross section having an axial annular flange extending into the hole 29 and a radial annular flange overlapping the top of the soundboard panel 27. Desirably the ring 33 is formed as a one piece injection molded member having integrally molded therewith a pick guard extension 34 lappingly engaging the top of the soundboard 27 at the customary pick strikeoff side of the hole 29 and the strings 21, that is at the right side as viewed in FIG. 1.

Mounting of the soundboard 27 on and across the top of the body 17 is desirably effected by means of an injection molded frame 35 (FIGS. 3, 5, 6, and 7), which is complementary in plan shape to the outline shape of the top of the body wall 23 and constructed and arranged to engage and be secured to the top of the body wall. For this purpose, the frame 35 has means comprising a head flange 37 constructed to overlie the top edge of the flange 23 and interlock therewith against inward displacement. A depending outer marginal interlock rib 38 on the flange 37 engages in a complementary upwardly and outwardly opening interlock recess groove 39 in the upper edge of the body wall 23, which at this point is the widest section of the wall. This provides an upwardly extending interlock rib 40 along the inner margin of the upper edge of the body wall 23, which engages interlockingly in a downwardly facing interlock groove 41 in the underside of the flange 27, defined between the interlock rib 38 and a depending flange 42 of the frame 35, which extends to a substantial width downwardly in face-to-face abutment with the inner surface of the upper portion of the body wall 23.

Complementary abutting upwardly and inwardly extending diagonal surfaces on the interlocking ribs 38 and 40 provide a cam interface 43 tending to draw the frame 35 and the wall 23 snugly together in assembly. Any suitable bonding material may be employed to secure the frame 35 permanently to the wall 23. A downwardly recessed ledge 44 over an inwardly extending ledge flange 45 on the frame 35 provides a seat for the margin of the soundboard 27, the depth of the recess seat being substantially equal to the thickness of the soundboard 27 so that the top surface of the soundboard is in substantially the same plane as the crown surface of the head flange 37. Means for securing the soundboard 27 in place in the stepped recess 44 may comprise suitable adhesive applied between the bottom of the soundboard 27 and the ledge flange 45. In addition, a molded plastic binding strip 47 overlies the crown surface of the frame head 37 and laps over an adjacent marginal portion of the soundboard 27. An outer marginal depending flange 48 on the binding strip 47 engages about the outer edge of the frame flange 37 and closely overlies a narrow ledge portion at the outer side of the groove 39 whereby to provide a neatly finished appearance for the juncture between the frame 35 and the wall 23 and the margin of the soundboard 27. Any suitable means for securing the finishing strip 47 to the associated surfaces of the assembly may be employed, such as epoxy cement or other suitable bonding material.

Figures 7, 8, 9, 10:
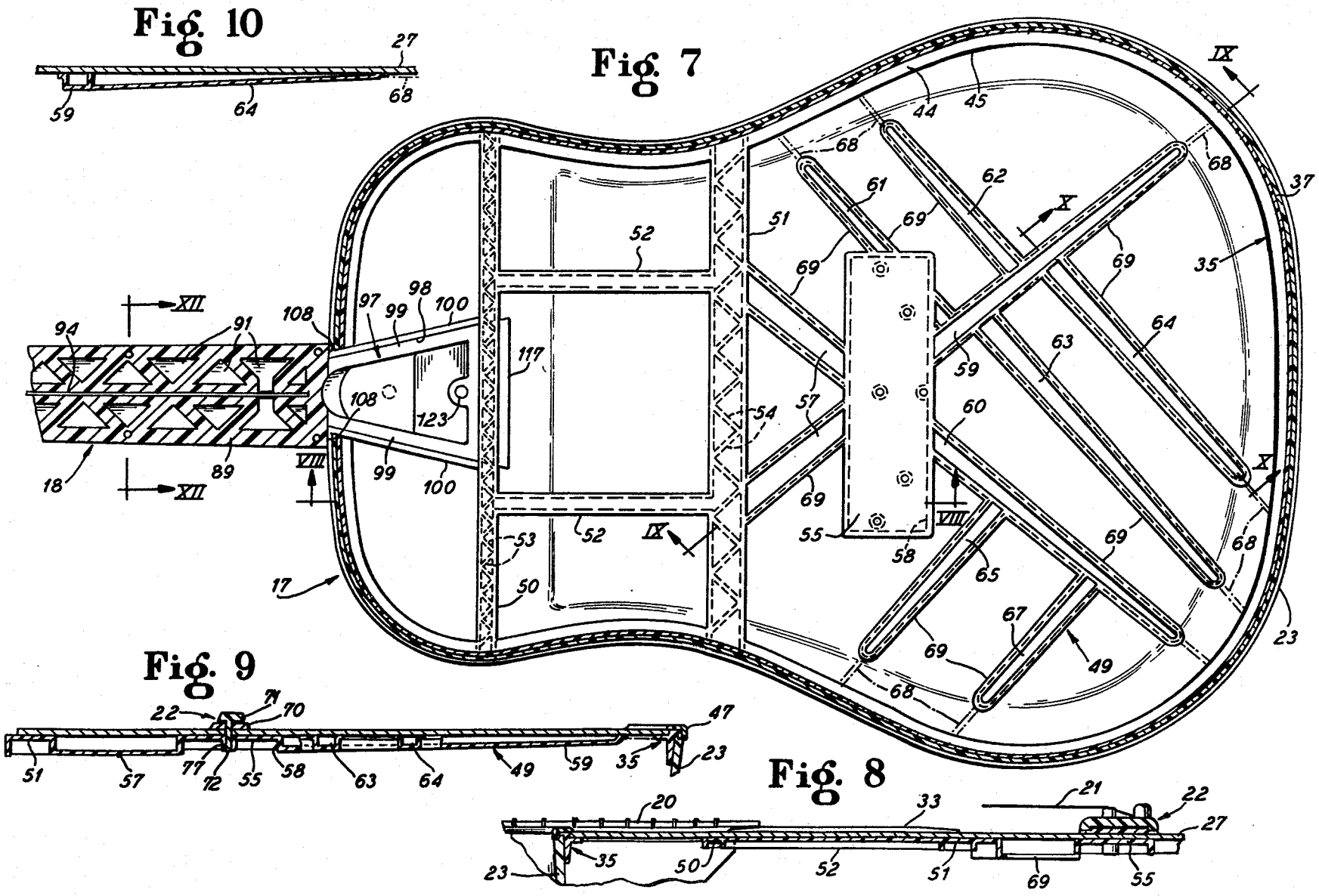
FIG. 7 is a top plan view of the guitar body with the top panel removed and shows a portion of the neck with the finger board removed.
FIG. 8 is a fragmentary sectional detail view taken substantially along the line VIII—VIII of FIG. 7.
FIG. 9 is a fragmentary sectional detail view taken substantially along the line IX—IX of FIG. 7.
FIG. 10 is a fragmentary sectional detail view taken substantially along the line X—X of FIG. 7.

An exceptionally great reduction in parts to be assembled in fabrication of the guitar assembly is attained by molding bracing means 49 (FIGS. 3, 5, and 7–10) for the underside of the soundboard 27, as an integral one piece structure, and more particularly integrally in one piece with the frame 35. Construction and arrangement of the bracing means 49 are such that the frame 35 and the bracing means 49 can be one shot injection molded from suitable material such as glass fiber reinforced styrene acrylonitrile copolymer. To this end, the bracing means 49 comprises an upper brace bar 50 extending between and integral with opposite sides of the frame 35 above the waist bouts of the body 17 to underlie the top panel adjacent to the upper side of the sound opening 29 (FIGS. 3 and 7). A brace bar 51 extends between and integral with opposite sides of the frame 35 at the lower sides of the waist bouts and adjacent to the lower side of the sound opening 29. Connecting the transverse brace bars 50 and 51 are spaced longitudinally extending connecting brace bars 52 one of each of which is located adjacent to the left and right sides of the sound opening 29. Thus the transverse and longitudinal brace bars 50, 51, and 52, all in an integral unit, provide a substantially rigid interconnecting substantially H-frame for the upper end portion of the soundboard 27 in the area thereof to which the neck 18 is attached and above the resonance area of the soundboard 27 to which the bridge 22 is attached. For maximum strength but minimum weight and economy of material, the brace bars 50, 51, and 52 are of hollow preferably generally U-shape cross section opening downward and with their upper planes common to one another and to the top of the frame flange 45. For additional rigidity, the brace bar 50 may be provided with a zigzag pattern of interconnected reinforcing struts 53. Similiarly the transverse brace bar 51 may be provided with a zigzag arrangement of interconnected reinforcing struts 54. In addition, it will be noted that the lower brace bar 54 is of larger size and therefore greater rigidity than the upper brace bar 50, whereby the lower brace bar 51 will serve efficiently for bracing the soundboard 27 against the forces generated by the highly tensioned tuned strings 21, through their anchorage to the bridge 22, which is connected to a mounting pad 55 forming part of the brace means 49 and underlying the bridge-carrying area of the soundboard 27 in suitably spaced relation below the transverse brace bar 51 and integrally connected to the bar 51 by means of a pair of truss bar 57, which extend divergently from the pad 55, and connect to the bar 51 in line with the adjacent ends of the longitudinal brace bar 52.

Below the transverse major frame bar 51, the bracing means 49 may be considered as providing a tuning system for the resonance area of the soundboard 27. For this purpose, connection of the mounting pad 55 to the brace bar 51 by the truss ribs 57 and the construction of the pad and truss ribs is such as to permit resonant up and down vibration while at the same time strongly resisting forces tending to displace the pad 55 in a longitudinal direction. For this purpose, the pad 55 is constructed as a flat upwardly facing panel equipped with downwardly projecting reinforcing flange 58 about its entire perimeter. On the other hand, the truss ribs 57 are of upwardly opening U-channel shape.

Radiating generally from the pad 55 under the resonance area of the soundboard 27 are tuning system ribs comprising a rib 59 extending coaxially with one of the truss ribs 57, but from the lower side of the pad 55 and generally toward the treble side of the soundboard. Extending symmetrically divergently relative to the tuning rib 59 and coaxially with the remaining truss rib 57 is a tuning rib 60 extending generally along the bass side of the soundboard 27. The ribs 59 and 60 are substantially identical and of substantially equal length and terminate at their lower ends adjacent to but desirably spaced from the frame 35 at the respective opposite sides of the lower bout of the body 17. Viewed in plan (FIG. 7) the ribs 59 and 60 are, in effect, extensions of the truss ribs 57, with the pad 55 at the projected crossing of the extended ribs. Additional treble side tuning ribs 61 and 62 extend in spaced parallel relation on axes substantially normal to the axis of the rib 59 with the rib 61 projected across the adjacent end of the pad 55 and the rib 62 spaced a short distance downwardly from the treble end of the generally transversely elongate pad 55. Projecting from the opposite side of the tuning rib 59 toward the lower portion of the base side is a tuning rib 63 on an axis normal to the axis of the rib 59 and offset slightly downwardly relative to the axis of the rib 61 with the distal end of the rib 63 adjacently spaced from the frame 35 and the distal end of the rib 60. A second tuning rib 64 extends in the same direction as the rib 63 from the rib 59 and has its axis offset slightly downwardly relative to the rib 62, substantially the same as the axis of the rib 63 is offset from the rib 61. At its distal end, the rib 64 terminates in spaced adjacency to the frame 35, substantially as shown. Extending on an axis normal to the rib 60 is a base side tuning rib 65 projecting in spaced adjacent relation to the base end of the pad 55 into spaced adjacent relation to the frame 35 at the distal end of the rib 65. A second base side tuning rib 67 projects integrally from an intermediate portion of the rib 60 spaced downwardly relative to the rib 65 and terminating at its distal end in adjacent spaced relation to the frame 35. For good molding practice and to obtain complete material fill during the injection molding, the distal ends of the several tuning ribs 61 to 67 may have slender sprue connections 68 with the frame 35, and serve as stabilizing connections to facilitate handling of the frame and bracing structure at least until the combination frame and bracing structure is assembled with the body 17 and the soundboard 27 assembled with the frame and brace structure. Thereafter, the sprue connections 68 may be snap broken away, so as not to interfere with tuning resonance afforded by the tuning system. All of the ribs 60–67 are tapered toward the frame 35 for efficient diaphragm action of the soundboard 27.

In order to afford adequate rigidity with minimum weight and most economical use of material, all of the tuning system ribs 61 to 67, similiarly as the truss ribs 57 are hollow and formed in generally U-channel cross section defining channels opening upwardly and closed by the soundboard panel 27. In order to facilitate adhesively bonding the tuning system ribs including the ribs 57 to the interface of the soundboard 27, all of the ribs 57 and 61–67 are provided along their upper edges with respective lateral attachment flanges 69, all in a common plane with the top of the frame flange 45, the top of the pad 55, and the brace ribs 50, 52, and 51, whereby to engage in planar interface abutment with the interface of the soundboard 27 for thorough uniform bonding thereto.

In a preferred construction, the bridge 22 (FIGS. 1, 3, 8, and 15) comprises an anchoring base 70, which rests flatwise against the top of the soundboard 27 aligned with the pad 55. At their interface, the bridge base 70 and the soundboard 27 may be bonded to one another by means of any suitable cement. Complementary to and assembled on top of the base 70 is a pad member 71, which is provided with a set of integral depending connecting prongs 72, which extend through matching apertures 73 in the base 70 and matching apertures 74 in the soundboard 27 and are received in matching sockets 75 in the bracing pad 55 opening at least upwardly and extending downwardly through tubular socket projections 77 on the pad 55. To facilitate assembly, and to provide a neat joint of the pad 71 with the base 70, a stepped complementary tongue and groove alignment structure is provided on the perimeter of the base 70 and the pad 71. In a preferred construction, the bridge base 70 and the bridge pad 71 are constructed as molded plastic parts from the same or similiar material as the bracing structure 49. In the bridge assembly, the parts 70, 71, may be cemented together and the connecting prongs 72 cemented in the sockets 75. In a preferred arrangement, as best seen in FIG. 7, there may be an array of six of the prongs 72 and sockets 75 symmetrically arranged to provide maximum resistance against separation of the parts when the bridge 22 is subjected to tuning tension of the strings 21.

Anchoring of the strings 21 to the bridge 22 is accommodated by entrance ports 79 properly located in the lower side of the bridge base 70 and terminating inwardly in respective sockets 80 (FIG. 15) receptive of respective anchoring lugs or knobs 81 fixedly secured to the anchor ends of the respective strings 21. In assembling the strings 21 with the bridge assembly 22, they are threaded from below through the entrance ports 79 and through respective passage slots 82 in integral bridge posts 83 extending upwardly from the lower portion of the bridge base 70 through complementary close fitting holes 84 in the bridge pad 71. From the slots 82 the strings 21 extend diagonally upwardly and through clearance grooves 85 in the adjacent portion of the bridge pad 71 and then over a saddle 87 in the form of a narrow bar secured in a complementary socket groove 88 in the top of the bridge pad 71. The posts 83 cooperating with the bridge pad 71 assure that there is a positive bracing attachment cooperation between the bridge base 70 and the bridge pad 71 and through the latter with the bracing pad 55, thus assuring excellent vibration response of the braced resonance area of the soundboard 27 during playing of the instrument.

Construction of the neck 18 is such as to provide maximum strength in a minimum weight and economical molded plastic structure. To this end the neck 18 comprises a molded plastic body 89 (FIGS. 7, 11, 12, and 13), which is of smoothly contoured underside with a substantially flat top 90 through which material saving hollow openings 91 open upwardly between crisscross struts 92 and a continuous longitudinal rib 93. A suitable material from which the body 89 is adapted to be molded is structural foam styrene acrylonitrile. For maximum reinforcement cooperating with the diagonal interbracing of the substantially hollow neck body 89, a longitudinally extending flat metal reinforcing bar 94 is molded in place longitudinally in the rib 93, with the major cross sectional plane of the bar extending in an up and down position within the rib 93. At spaced intervals, the reinforcing bar 94 has keying apertures 95 so that the material of the rib 93 is thoroughly keyed through the keying apertures 95 with the bar 94.

At its heel end, the neck 18 is assembled with the upper bout of the body 17 in a manner, not only to minimize heel area projection from the body, but also to effect a highly efficient rigidly fixed attachment of the neck to the body 17. To this end, the heel end of the neck 18 has an integrally molded heel structure 97 (FIGS. 3 and 7) which is constructed and arranged to be received in a complementary socket molded centrally in the upper bout of the body 17. Although the heel structure 97 is of an upwardly opening hollow construction as shown, it is shaped for maximum rigidity having generally angularly related walls comprising side walls 99, which diverge from the heel end of the elongate neck body 89, and provides sidewardly facing wedge-like surfaces which engage with complementary surfaces within the socket 98 provided by opposite sides socket walls 100, which extend integrally from the upper bout portion of the body wall 23 and are connected integrally in bracing relation with the bottom 24. The contruction of the heel structure 97 and the socket 98 are such that the heel structure can be assembled by dropping it downwardly into the socket 98 before the combination frame 35 and bracing structure 49 have been assembled with the body. As thus assembled, a bottom end 101 of the heel structure 97 engages a seat 102 on the upper bout end of the bottom 24 and an inner wall 103 of the heel structure 97 providing an upwardly and inwardly oblique cam surface 104 cooperates with an upstanding inner wall portion 105 defining the socket 98 to effect tight cooperating engagement between the abutting surfaces provided by the heel structure walls 99 and the socket walls 100. At its upper edge, the inner socket wall 105, which is shorter than the height of the heel structure 97 engages a stabilizing shoulder 107, providing a firm abutment resisting any tendency for the heel structure 97 to tilt when the strings 21 are tightened for tuning. This cooperates with additional bracing provided by shoulder areas along the outwardly opening slot through the wall 23 provided at the outer end of the socket 98 with shoulders 108 extending laterally at each of the outer sides of the heel structure walls 99. Additional locking of the heel structure 97 in the socket 98 is provided for by a tongue flange 109 projecting upwardly narrowly from the outer end of the seat 102 and engaging in a complementary interlock groove 110 in the outer end of the bottom 101. Yet additional interlock is provided by a heel plate 111 set into a complementary recess 112 in the underside of the seat 102 and having an upwardly projecting index boss 113 extending upwardly in a complementary aperture 114 in the seat 102 and received in an interlock socket 115 in the bottom wall 101 of the heel structure 97.

Further interlocking of the heel structure 97 with the other components of the instrument is effected by means of an inner upper transverse beam portion 117 comprising an extension from the inner wall 103 and integral with the upper inner ends of the side walls 99 and interlockingly engaged with the transverse front brace bar 50. For this purpose, the beam 117 has a pair of spaced parallel upwardly opening transversely extended grooves 118 within which are received the downwardly projecting reinforcing flanges of the bar 50. As a result, after the heel structure 97 has been assembled in the socket 98 and the abutting surfaces bonded as by means of high shear adhesive and all of the mechanical interlocks including the interlock with the bar 50 are interengaged, the neck 18 is extremely thoroughly attached to the body 17 against any distorting forces and in particular against the leverage forces exerted by the tensioned strings 21. In addition, by reception of the heel structure 97 largely within the body 17, with only the minimum exposure at the outer side of the heel structure 97 barely sufficient to provide the shoulders 108, easier fingering of the lower fret scales is afforded.

Although the finger board 20 may be constructed as a plastic molding, it may also as shown (FIGS. 1 and 12) be made from wood in a more traditional manner with frets 119 inserted in the upper surface of the board. On its lower surface, the board 20 firmly engages and is secured to the upper face 90 of the neck body 89 by any suitable means, such as adhesive bonding and desirably also by means of pegs 120 fitting into peg holes 121 opening upwardly through the neck face 90. At its lower end, the fret board extends to and is aligned with and overlies the upper bout side of the purfling ring 33. Where the fret board overlies the beam 117, it is desirably anchored to the beam by means of a downwardly projecting peg 122 projecting into an upwardly opening socket 123. At its upper end, the fret board 20 terminates at a string separator bar or nut 124 (FIGS. 1, 11 and 13), which is desirably constructed as a plastic molding having string separating grooves 125 in its upper transversely convex surface. On its lower surface, the nut 124 is adapted to engage the top of the neck body 89 and has adjacent to each opposite end a depending locating peg 127 engaging in a complementary socket 128, provided therefore in the neck body. The nut 124 need not be permanently secured to the neck body 89 because in the playing condition of the instrument, the strings 21 hold the nut in place; furthermore, by having the nut 124 replaceablely mounted on the neck 89, it can be raised and one or more shims 129 placed between the nut and the top surface of the neck in order to raise the nut for height adjustment when necessary. The shims may extend entirely across the neck under the nut 124 or may comprise perforated platic pieces mounted about the root ends of the pegs 127.

To accommodate the tuning machine in the tuning or machine head 19, the upper end portion of the neck 18 is provided with a panel extension 130 (FIGS. 2, 4, 11, and 14) molded integrally in one piece therewith and angled downwardly to provide the customary angle for guitar tuning heads. From the position at which the nut 124 is mounted, the base panel 130 is offset to receive a complementary pegboard cover plate 131 which is adapted to be removeably secured in place as by means of screws 132 extending upwardly through the base panel 130 and threadedly engaged in nuts 133 embedded in the interface of the plate 131 (FIG. 4). For accurately locating the plate 131 in assembly and maintaining it against longitudinal or transverse displacement, cooperatively with the screws 132, a tongue and groove marginal interconnection 134 is provided between the panel 130 and the plate.

Means are provided within the head 19, that is between the base panel 130 and the plate 131, for accommodating tuning gear comprising tuning keys 135 accessible at the opposite sides of the head and gear structure for coupling the keys 135 to tuning posts or pegs 137. In a desirable construction, the keys 135 and the pegs 137 are constructed as simple injection molded plastic parts preferably made from nylon containing a high percentage of glass fibers for maximum strength to resist thoroughly distortion from high string tension. Nylon possess substantial lubricity characteristic eliminating the necessity for special bearing elements in the tuning gear as well as eliminating the need for messy lubricants. In addition, each of the keys 135 and its associated peg 137 comprises a simple two-part assembly including coupling gear means.

Each of the keys 135 is assembled with a worm 138 injection molded from the same material. A coupled relationship of the key 135 with the worm 138 in each instance is effected by means of an integral axial coupling stem 139 of the key extending into and permanently secured in a complementary bore 140 coaxially in the worm 138. For positive keyed torque union, the cross sectional shape of the coupling stem 139 and bore 140 is out of round such as square as shown in FIG. 14. Each of the worms 138 is received in rotatable bearing relation in a complementary bearing recess 141 at the interface of the panel 130 and the pegboard plate 131, one half of the bearing recess 141 being formed in the panel 130 and the complementary remaining half being formed in the plate 131. To retain the key-worm assembly against longitudinal displacement, the worm 138 in each instance is provided at its opposite ends with respective annular thrust shoulder collar ribs 142, which are received in complementary annular thrust shoulder grooves 143 formed as part of the bearing recess 141. To stabilize bearing engagement between the worm 138 and the supporting head structure, an annular journal surface 144 is provided at the outer or key end of the worm 138 engaging with an annular bearing surface 145 formed at that end of the bearing recess 141. At its opposite or inner end, the worm 138 is provided with an annular axially extending journal surface 147 engaged in a complementary annular bearing surface 148 at the inner end of the bearing recess 141.

Each of the pegs 137 is comprised of two injection molded parts comprising a peg body 149 formed on its lower or inner end with one part, such as one half, of a worm gear 150, the remaining part of the worm gear being provided on a complementary molded part 151, which is assembled with and permanently secured in assembly, such as by means of adhesive with the lower or inner end of the peg body 149. For accurately indexed torque sure coaxial assembly of the part 151 with the body 149, a non-round e.g. square, axial key lug 152 is formed on the upper end of the gear part 151 and fits in a complementary coaxial keying recess 153, provided at the lower end of the peg body 149. At its lower end, the gear part 151 is formed with a coaxial annular axially extending journal surface 154, which fits rotatably in a complementary bearing recess 155 in the panel 130, at the lower end of a recess 157, within which the worm gear 150 is accommodated in meshing relation to the worm 141 in the interface area of the panel 130 and the plate 131.

From the recess 157, the peg body 149, which is externally cylindrical for the purpose, extends upwardly through a complementary bearing bore 158 in the plate 131 coaxial with the recess 157. The length of the cylindrical bearing provided by the bore 158 is ample to withstand in firm, stable relation maximum torque forces that may be generated in use of the peg 137 for its intended string tensioning purposes.

Each of the pegs 137 is provided at the upper, outer end of the body 149 with an integral head 159 and string winding neck 160. For anchoring the associated tuning string 21, each of the pegs 137 is desirably provided with at least an axial bore 161 to receive the terminal portion 162 of the associated string which is conveniently inserted into the bore 161 through the top of the head 159 through which the bore opens and which has a slot 163 to facilitate manuvering the string 21 into wound position about the neck 160 by manipulation of the associated key 135 to turn the peg 137. By extending downwardly in the bore 161, the terminal 162 snags against a snagging shoulder 164 at the juncture of the bore 161 and the entrance slot 163, thereby holding the string with tuning tension. For even more positive retention of the string, if desired, a transverse string hole 165 may be provided in the neck 160, desirably aligned with the slot 163 and the string 21 may be threaded through the hole 165, in addition to having the terminal portion 162 projecting down into the bore 161. The stringing arrangement for the pegs 137 not only permits easy string attachment, but also eliminates all injury hazard from the conventional exposed string terminals, because herein the string terminals are completely confined within pegs 137, i.e., in the bore chambers 161.

Although the several ribs of the bracing means 49 have been shown in the best mode as tapered to diminish to progressively less rigidity as they approach the perimeter of the body 17, such ribs may be formed to diminish by progressive stepped increments to attain substantially the same result.

From the foregoing, it will be apparent that the guitar construction of the present invention provides for the fabrication of all or most of the parts from polymeric material. All assemblies and subassemblies are so constructed, arranged, and related that the parts can be easily, simply, accurately, and quickly put together by even relatively unskilled labor, without the need of assembly fixtures. Nevertheless, the finished instrument is capable of quality performance.

It will be understood that variations and modifications may be effected without departing from the spirit and scope of the novel concepts of this invention.

I claim as my invention:

1. A musical instrument of the guitar type, having a soundbox body to which is attached a neck having a tuning machine head, a top panel on said body carrying a bridge and saddle, strings attached at one of their ends to said bridge and extending across said saddle and connected at opposite ends to tuning gear of the machine head, said top panel having a sound hole under said strings, the improvement comprising:

said body being of plastic and formed in one piece and having a substantially rigid wall defining the perimeter of the body and extending upwardly from juncture with a shaped bottom;

said bottom having a concave-convex parabolic sound reflector area;

said sound reflector area having its perimeter upwardly inset relative to the lower edge of said wall;

and a bracing rib of substantially open generally S-shaped cross-section considered across the bracing rib, and joining said sound reflector area to the lower end of said wall on respective angular open junctures and without interfering with resonance vibrational qualities of the sound reflector area.

2. An instrument according to claim 1, wherein said wall tapers from a thicker section at the top to a substantially thinner section where said rib means join the lower end of the wall.

3. An instrument according to claim 1, including a reinforcing and supporting frame mounted on top of the upper edge of said wall and having a recessed seat for the edge of said top panel, said top panel mounted along its edge in said recessed seat of said frame, and said frame having a depending flange engaging with said wall.

4. An instrument according to claim 3, wherein said frame is constructed as an injection molded member, and bracing means integrally molded with said frame and attached to the inner face of said top panel.

5. An instrument according to claim 1, wherein said bridge comprises a base member having means for anchoring said one ends of the strings thereto, a pad member complementary to and engaged on top of said base member, means on the pad member securing the base member and the pad member in assembly to said top panel, and said saddle carried by said pad member and the strings extending from their anchored ends in tensioned relation across and in engagement with said saddle.

6. An instrument according to claim 1, wherein said neck comprises a reinforced molded plastic structure having on its end attached to said body a heel portion provided with an anchoring structure, said body having an upper bout socket, which opens toward the top of the body and is complementary to and has said anchoring structure assembled therein, said anchoring structure and said socket having mating surfaces which automatically interlock by downward assembly of the anchoring structure into the socket to retain the neck against sidewise or longitudinal displacement relative to the body, and means fixedly securing said anchoring structure in said socket against displacement relative to the top or bottom of the body.

7. A musical instrument according to claim 1, wherein said neck comprises an elongate member molded from lightweight plastic material, a finger board having frets and mounted on said neck member, an elongate sheet metal reinforcing element moldably embedded and extending lengthwise in said neck member, said reinforcing element having a flat plane extending normal to said finger board whereby to provide maximum resistance to bending of said neck member under tension, and interlock holes through said element in which material of the neck member is interlockingly molded.

8. A musical instrument according to claim 1, wherein said neck comprises a reinforced molded plastic unit, said tuning gear head comprises a panel integral with said neck, a head plate complementary to and mating with said panel, said panel and said plate having tuning gear recesses at their interface, with said recesses being partly in the panel and partly in the plate in each instance and defining bearing surfaces, sets of meshing tuning gears and post gears assembled in said gear recesses, means providing stabilizing journal surfaces on the gears engaging bearing surfaces of the receses, tuning posts extending from said post gears through bearing holes in said plate and having means for attachment of the playing strings thereto, and tuning keys extending from said tuning gears and manipulatable externally of said head.

9. A musical instrument of the guitar type, having a soundbox body to which is attached a neck having a tuning machine head, a top panel on said body carrying a bridge and saddle, strings attached to said bridge and extending across said saddle and connected to tuning gear of the machine head, said top panel having a sound hole under said strings, the improvement comprising:

a reinforcing and supporting frame mounted on the upper edge of a wall defining the perimeter of the body;

said upper edge of said wall and said supporting frame having interlocking tongue and groove means;

said frame having a recessed ledge on which the edge of said top panel is engaged;

and a depending stabilizing flange on said frame engaging the inside of said wall below said ledge.

10. An instrument according to claim 9, wherein said ledge is defined at least in part by a flange projecting inwardly from the top of said stabilizing flange, and bracing means attached to said ledge flange and engaging the underside of said top panel.

11. An instrument according to claim 10, wherein said frame and said bracing means are formed as an integral one piece injection molding.

12. An instrument according to claim 11, wherein said bracing means comprise a system of reinforcing bars and resonance controlling ribs integrally joined together in said molding.

13. An instrument according to claim 9, including pad means connected to said frame and underlying said bridge, and means extending from said bridge and securing the bridge to said pad means.

14. A musical instrument of the guitar type, having a soundbox body to which is attached a neck having a tuning machine head, a top soundboard panel on said body carrying a bridge and saddle, strings attached to said bridge and extending across said saddle and connected to tuning gear of the machine head, said top panel having a sound hole under said strings, the improvement comprising:

bracing means comprising hollow reinforcing bars and hollow resonance controlling ribs connected together in a one piece molded plastic structure, and means securing said bars and said ribs to the underside of said top panel.

15. An instrument according to claim 14, wherein said structure includes an attachment pad molded therewith and underlying said bridge, and means extending inwardly from said bridge and securing it to said pad.

16. An instrument according to claim 14, wherein said reinforcing bars are located in the vicinity of said sound hole, and said ribs have longitudinal channels therein opening toward said top panel and are secured to a resonant diaphragm area of the top panel, said top panel closing said channels.

17. An instrument according to claim 16, wherein said reinforcing bars are hollow and have an array of reinforcing struts therein.

18. An instrument according to claim 17, wherein said ribs have lateral attachment flanges along edges adjacent to said top panel and said flanges engaging said top panel.

19. An instrument according to claim 14, wherein said ribs and bars have walls of substantially uniform section thickness.

20. An instrument according to claim 16, wherein said ribs extend in a generally radiating array from said bars, and said ribs taper toward the perimeter of said top panel.

21. An instrument according to claim 14, wherein said neck has a heel structure in anchored connection with said body, and said bars include means interlocked with said heel structure.

22. A musical instrument of the guitar type, having a soundbox body to which is attached a neck having a tuning machine head, a top soundboard panel on said body carrying a bridge and saddle, strings attached to said bridge and extending across said saddle and connected to tuning gear of the machine head, said top panel having a sound hole under said strings, the improvement comprising:

said bridge comprising a base member having means for anchoring the strings thereto;

a pad member complementary to and engaged on top of said base member;

posts projecting up from said base member and extending through complementary holes in said pad member and assuring positive bracing attachment cooperation between the base member and the pad member;

connecting means on the pad member securing the base member and the pad member in assembly to said top panel;

and said saddle carried by said pad member and the strings extending from their anchored ends through clearance means in said pad member and engaging in tensioned relation across said saddle.

23. An instrument according to claim 22, including bracing means attached to the inner face of said top panel and including an attachment pad structure having sockets, and said connecting means on said pad member comprising prongs received in said sockets and thereby attached to said pad structure.

24. An instrument according to claim 23, wherein said bracing means include reinforcing bars in the vicinity of said sound hole and resonance controlling ribs, said bars and ribs and said pad structure comprising a one piece molding.

25. An instrument according to claim 24, including a mounting frame comprising a part of said one piece molding and engaged on the upper edge of a wall defining the perimeter of said body, and said top panel mounted on said frame.

26. A musical instrument of the guitar type, according to claim 1, wherein said neck comprises a reinforced molded plastic structure having on its end attached to said body a heel portion provided with an anchoring structure;

said body having an upper bout socket which opens toward the top of the body and is complementary to and has said anchoring structure assembled therein;

said anchoring structure and said socket having mating surfaces which automatically interlock by downward assembly of the anchoring structure into the socket to retain the neck against sidewise or longitudinal displacement relative to the body;

and means fixedly securing said anchoring structure in said socket against displacement relative to the top or bottom of the body.

27. An instrument according to claim 26, wherein said anchoring structure comprises beam means, and bracing means engaging the lower face of said top panel and interlocked with said beam means.

28. An instrument according to claim 27, wherein said body has a wall defining the perimeter of the body, frame means connected to said bracing means and mounted on the upper edge of said wall, and said top panel mounted on said frame means.

29. An instrument according to claim 26, wherein said anchoring structure and said body at said socket have cooperating abutment and shoulder means to retain the neck against displacement under string tension.

30. An instrument according to claim 26, including a heel plate secured to said body under said socket and having means interlocked with the bottom of said anchoring structure to assist in indexing said anchoring structure of proper neck alignment.

31. A musical instrument of the guitar type, according to claim 1, wherein:

said neck comprises an elongate member molded from lightweight plastic material;

a finger board having frets and mounted on said neck member;

an elongate sheet metal reinforcing element moldably embedded and extending lengthwise in said neck member;

said reinforcing element having a flat plane extending normal to said finger board whereby to provide maximum resistance to bending of said neck member under string tension;

and interlock holes through said element in which material of the neck member is interlockingly molded.

32. An instrument according to claim 31, said neck having a heel structure, said body having a socket within which said heel structure is slideably engaged, and said structure and said socket having surfaces which are slideably interengaged and retain the heel structure against displacement both longitudinally and sidewardly relative to said body.

33. An instrument according to claim 31, wherein said tuning machine head comprises a plate integrated with the neck and offset below said finger board, a tuning peg plate mounted on said panel and providing with said panel gear housing means, tuning keys having worms rotatably mounted in said housing means, tuning pegs extending through said panel and having worm gears meshing with said worms, and means on said pegs to which said strings are attached.

34. An instrument according to claim 33, wherein said pegs have internal chambers in which terminals of said strings are enclosed.

35. A musical instrument of the guitar type, according to claim 1, wherein:

said neck comprises a reinforced molded plastic unit;

said tuning gear head comprising a panel integral with said neck;

a head plate complementary to and mating with said panel, said panel and said plate having tuning gear recesses at their interface, with said recesses being partly in the panel and partly in the plate in each instance and defining bearing surfaces;

sets of meshing tuning gears and post gears assembled in said gear recesses;

means providing stabilizing journal surfaces on the gears engaging bearing surfaces of the recesses;

tuning posts extending from said post gears through bearing holes in said plate and having means for attachment of the playing strings thereto;

and tuning keys extending from said tuning gears and manipulatable externally of said head.

36. An instrument according to claim 35, wherein said tuning keys and said tuning gears are molded plastic members assembled together, said tuning keys having keying stems and said tuning gears having keying recesses in which such stems are engaged.

37. An instrument according to claim 35, wherein said tuning posts and post gears are molded nylon structures, and said head plate comprising a plastic molding wherein the bearing holes comprise bearing surfaces which are part of the plate molding and in which said posts are journaled.

38. An instrument according to claim 35, wherein said tuning posts have internal chambers in which terminals of said strings are housed.

39. An instrument according to claim 38, wherein said posts have string winding necks with which said chambers communicate for receiving the string terminals.

40. An instrument according to claim 39, wherein said posts have heads above said necks, and slots in said heads communicating with said chambers to facilitate manipulating the strings into position on the posts.

41. An instrument according to claim 1, including a nut extending across said neck adjacent to said tuning machine head and across which nut the strings extend from said saddle to said tuning gear of the machine head, said nut comprising a bar having depending pegs, said neck having sockets in which said pegs are received removeably, said nut being removeable for application of shim means between the nut and the underlying surface of the neck for adjusting the height of the nut.

42. A musical instrument of the guitar type, having a soundbox body to the upper bout of which is attached a heel end of a neck having a tuning machine head at its opposite end, a top soundboard panel on said body carrying a bridge and saddle on a resonance area of the panel, strings attached to said bridge and extending across said saddle and connected to tuning gear of the maching head, said top panel having in the upper portion thereof between said bridge and said heel end of said neck a sound hole under said strings, the improvement comprising:

a one piece molded plastic frame conforming to the outline defined by an upstanding continuous wall of said body and mounted on the upper edge of said wall, said frame supporting said soundboard panel;

and bracing means comprising brace bars, a bridge-mounting pad and tuning system ribs, all molded integrally in one piece with said frame, so that the entire frame and bracing means can be assembled as a unit with said body wall, and wherein:

said brace bars comprising a transverse bar extending between and integral with opposite sides of said frame and underlying said panel adjacent to the upper side of said opening, a transverse brace bar extending between and integral with opposite sides of the frame adjacent to the lower side of the sound opening, and connecting spaced longitudinally extending brace bars located adjacent to the left and right sides of said opening and integral at their opposite ends with said upper and lower transverse brace bars;

truss rib means integral with and connecting said pad in spaced relation with the lower of said bars permitting resonant up and down vibration while at the same time strongly resisting forces tending to displace the pad in a longitudinal direction, said pad and and said bridge having means connecting them together;

said tuning system ribs comprising divergently extending ribs integral with said pad and extending in the opposite direction from said pad relative to said truss ribs, and a plurality of tuning ribs integral with and projecting from said divergently extending ribs, said ribs having ends which are spaced from but project towards said frame and having in the originally molded state slender sprue connections with the frame serving as stabilizing connections to facilitate handling of the frame and bracing means at least until the frame and bracing means are assembled as a unit with said body wall and said panel assembled with the frame and bracing means, said sprue connections being adapted to be broken away after assembly with the frame and panel so as not to interfere with tuning resonance afforded by the tuning system comprising said panel and said tuning ribs.

43. An instrument according to claim 42, wherein said transverse bars are hollow and said lower transverse bar is stiffer than the upper of said transverse bars.

44. An instrument according to claim 43, wherein said tuning ribs are hollow and of substantially uniform wall thickness and taper toward said frame.

* * * * *